US005516308A

United States Patent [19]

Yamanashi

[11] Patent Number: 5,516,308

[45] Date of Patent: May 14, 1996

[54] CONNECTOR EQUIPPED WITH COMB-LIKE TERMINAL LOCKING TOOL

[75] Inventor: Makoto Yamanashi, Haibara, Japan

[73] Assignee: Yazaki Corporation, Tokyo, Japan

[21] Appl. No.: 295,531

[22] Filed: Aug. 25, 1994

[30] Foreign Application Priority Data

Sep. 1, 1993 [JP] Japan ..... 5-217687

[51] Int. Cl.[6] ..... H01R 13/436

[52] U.S. Cl. ..... 439/752

[58] Field of Search ..... 439/752, 595

[56] References Cited

U.S. PATENT DOCUMENTS 4,867,712 9/1989 Kato et al. ..... 439/752

5,299,958 4/1994 Ohsumi ..... 439/752

*Primary Examiner*—Gary F. Paumen

*Attorney, Agent, or Firm*—Armstrong, Westerman, Hattori, McLeland & Naughton

[57] ABSTRACT

A connector equipped with a terminal locking tool includes a connector housing having a plurality of terminal chambers, an opening portion provided on the outer peripheral wall and a plurality of recesses penetrating through the housing so as to traverse partitions between the terminal chambers from the opening portion; and a terminal locking tool having a cover plate, wall pieces and two side pieces to be inserted into the recesses, which are arranged in a comb-shape on said cover plate. The side pieces have ribs at predetermined positions, and the connector housing has rib guiding grooves for guiding said ribs. The rib guiding grooves correspond in shape to the ribs and are provided at the recesses where the side associated pieces are to be located. Thus, the comb-like terminal locking tool can be smoothly inserted into the connector housing.

9 Claims, 7 Drawing Sheets

CONNECTOR EQUIPPED WITH COMB-LIKE TERMINAL LOCKING TOOL

BACKGROUND OF THE INVENTION

1. Field of the Invention

The present invention relates to a connector used for connection of a wire harness for vehicles, and more particularly to a connector equipped with a terminal locking tool.

2. Description of the Prior Art

In FIG. 8, element a denotes a female connector housing made of synthetic resin insulating material, element b denotes a terminal locking tool made of the same material, and element c also denotes a male connector housing of the same material.

The connector housing includes plural terminal chambers d,d, . . . arranged in two upper and lower stages. At the intermediate portion of the lower outer peripheral wall al of the connector housing a, successive recesses each vertically penetrating through the housing a to traverse the partitions d1, d1, . . . are successively formed to be extended from a continuous opening portion e'. At the front portion of the connector housing a, a mantle portion a2 for receiving a male connector housing (not shown)is formed.

The terminal locking tool b has a comb-like shape, and includes a cover plate b1, wall pieces b2 and b3 and side plates b4 and b4. The cover plate b1 is adapted to close the opening portion e' of the lower outer peripheral wall al. The wall pieces b2 and b3, which correspond and join to the partitions d1, d1, . . . between the respective terminal chambers, are formed to protrude from the cover plate portion b1. The side plate portions b4 and b4, which are also used as the side walls of both left and right terminal chambers d and d, are formed on the outermost sides of the cover plate b1. The wall pieces b2, b2, . . . which correspond to the terminal chambers for the two upper and lower stages of terminal chambers d are made longer than the wall pieces b3, b3, . . . for one stage. The side plate portions b4 and b4 are made longer than the intermediate wall pieces b2, b2, . . . . On both surfaces of each wall piece b2, and b3 and on the inner surface of the side plate portion b4, terminal locking portions g, g, . . . are protruded which are engaged with the locking pieces f, f, . . . (described later) of the male terminal C. At the lower end of the front end surface of the side plate portion b4, a provisional locking protrusion h is formed, and on the rear surface of a resilient lever arm k (fixed at positions a and D as shown) having a rear locking protrusion i is provided through a slit i (FIG. 9).

Within the connector housing a, as shown in FIG. 9, a provisional locking engagement portion 1 and a final engagement portion m are provided correspondingly to the provisional locking protrusion h and final locking protrusion i of the terminal locking tool b.

The provisional engagement portion 1, when the terminal locking tool b is inserted into the recess e of the connector housing a, is engaged with the provisional engagement protrusion h to lock the terminal locking tool b provisionally. The provisional engagement portion 1 is so located that a terminal is preferably first stopped outside the terminal chamber d to permit insertion of the male terminal c (provisional locking position).

On the other hand, the final engagement portion m, when the terminal locking tool b is further inserted into the connector housing a to be shifted from the provisional locking position, is engaged with the final locking protrusion i to lock the terminal locking tool b. The final engagement portion m is so located that the terminal locking portion g is engaged with the locking piece f of a male terminal c so that it cannot be removed off backwardly from the final locking position.

When the locking tool b is in its provisional locking position the terminal locking portion g provided at each of the wall pieces b2, b3 and side plate portions b4 is separated from the corresponding terminal chamber d so that the male terminal c can be removed from the rear of the connector housing a.

With the locking tool b in the above locking position, when the male terminal c is inserted into the terminal chamber d, as shown in FIG. 10, the resilient locking arm n within the terminal chamber d is engaged with the locking groove c2 of the intermediate portion c1 so that the terminal c is initially primarily.

In this state, when the terminal locking tool b is shifted to the final locking position, the terminal locking portion g provided at the wall piece b2 of the terminal locking tool b, etc. is located behind the locking piece f of an electric contact portion c1 to be engaged with it. Thus, double-locking of the male terminal c can be realized.

In the above construction, both side plate portions b4, b4 are longer than the central portions. In addition, since there is a slit i to the locking protrusion i for real locking can be deformed. For these reasons, after the terminal locking tool b is molded, as shown by a phantom line in FIG. 12, both side plate portions b4, b4 are likely to be deformed inwardly. In setting the terminal locking tool b, thus deformed, at the provisional locking position of the connector housing a, it can be inserted in the recess e only while both side plates b4, b4 are deflected outwardly to be reformed to their normal shape by a hand or tool. But, thereafter, while the terminal locking tool b is pushed into the provisional locking position, both side plate portions b4, b4 will be restored to the previous deformed state. When the side plate portions b4 deform, as shown, their tips are caused to hit on the steps P within the connector housing a. Then, it becomes difficult or impossible to insert the terminal locking tool b further into the connector a and the tool may be destroyed.

SUMMARY OF THE INVENTION

An object of the present invention is to provide a connector equipped with a comb-like terminal locking tool which can be mounted at the provisional locking position of a connector housing.

In order to attain the above object, in accordance with the present invention, there is provided a connector equipped with a comb-like terminal locking tool, comprising a connector housing having a terminal chamber, an opening portion provided on the outer peripheral wall and recesses penetrating through the housing so as to traverse a partition of the chamber from the opening portion; and a terminal locking tool having a cover plate, a wall piece and side pieces to be inserted into the recess which are arranged in a comb-shape on the cover plate; each of the side pieces having extended ribs at predetermined positions; and the connector housing having rib guiding grooves for guiding the ribs, the rib guiding grooves corresponding to the ribs and being provided independently of the terminal chamber which the side pieces overlook.

In operation, when a terminal locking tool for the connector housing is mounted, the rib is engaged with the rib guide groove so that the postures of both side plate portions can be reformed.

Since the connector according to the present invention has the above structure, a comb-like terminal locking tool can be smoothly inserted into the recess of the connector housing, thus preventing the terminal locking tool from being destroyed.

The above and other objects and features of the present invention will be more apparent from the following description taken in conjunction with the accompanying drawings.

DESCRIPTION OF THE PREFERRED EMBODIMENTS

Embodiment 1

Figure 1:
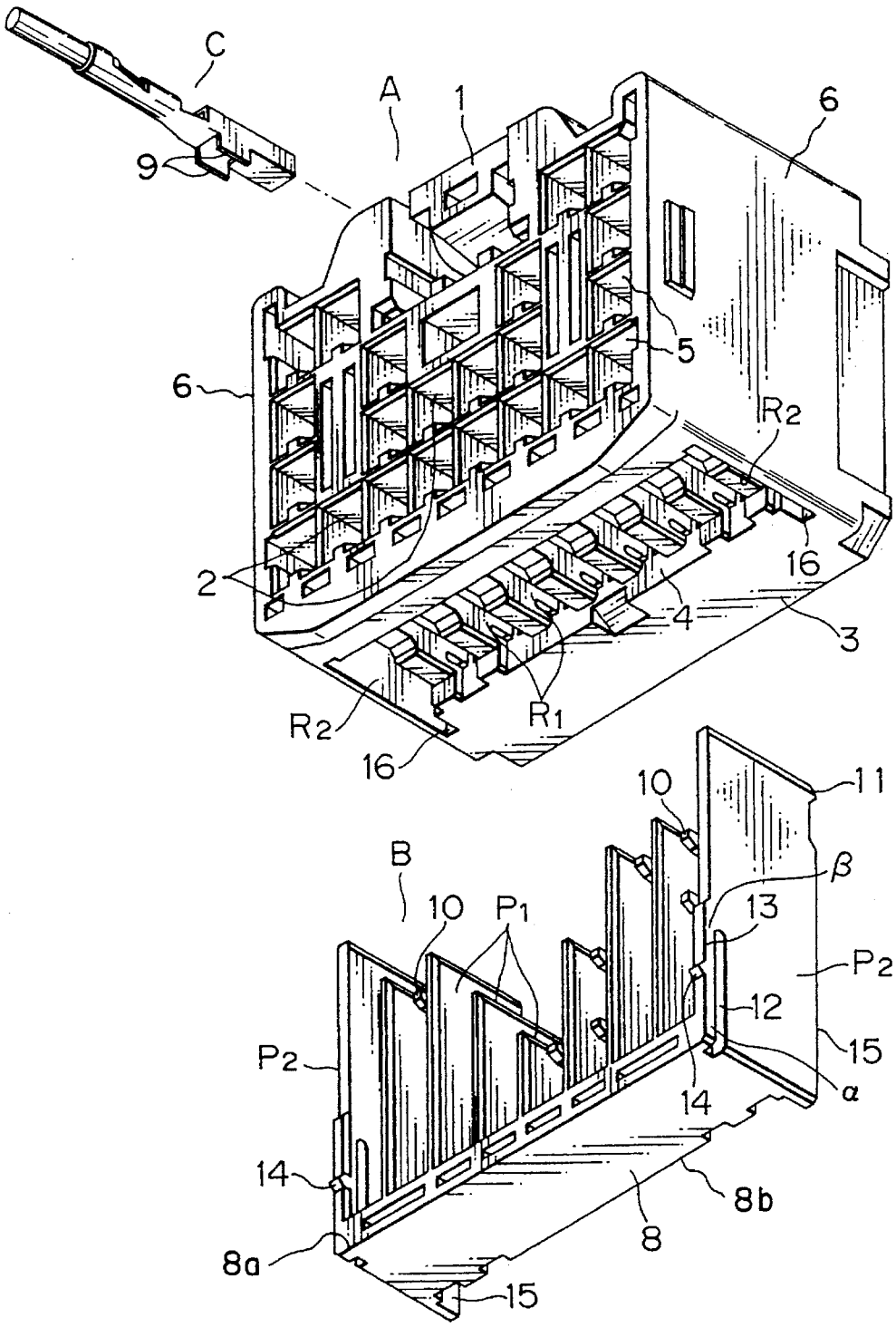
FIG. 1 is an exploded perspective view of one embodiment of the present invention.

In FIG. 1, element A denotes a female connector housing of synthetic resin: element B denotes a comb-like terminal locking tool; and element C denotes a male terminal metal fitting. The connector housing A includes a locking arm 1 in its exterior, terminal chambers 2 arranged in a horizontal direction at plural stages in a vertical direction in its interior, a straight opening 4 made at the intermediate portion of its lower outer peripheral wall 3, and recesses R1 and R2 each vertically penetrating through the housing A to partially traverse the partitions 5, 5, . . . of the terminal chambers and both side walls 6.

The terminal locking tool B has a comb-like shape, and includes a cover plate 8 having a rear elongated edge 8*a* and a front elongated edge 8*b* spaced therefrom and small and large wall pieces P1 and side pieces P2. The cover plate 8 is received in and serves to close the opening portion 4 of the lower outer peripheral wall 3. The small and large wall pieces P1 and P2, which are arranged in parallel on the cover plate 8, correspond to the above recesses R1 and R2. 0n both surfaces of each wall piece P1 and on the inner surface of each side plate portion P2, terminal locking portions 10, 10, . . . are protruded which engage with the locking pieces 9, 9, . . . of the terminal metal fittings C.

Figure 3:
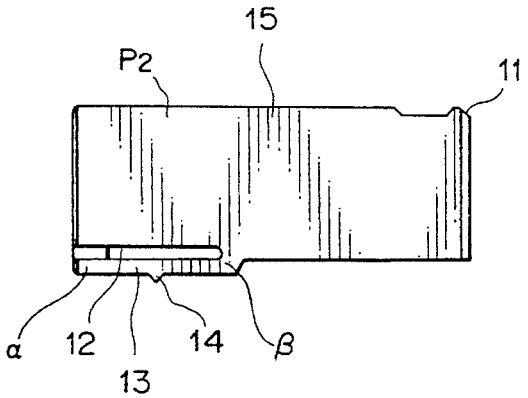
FIG. 3 is a side view of the terminal locking tool.

On the front end surface of each of the side pieces P2, a provisional locking protrusion 11 is provided, and on the rear end surface thereof, a final locking protrusion 14 is provided which is located on a resilient lever arm 13 (fixed at positions α and β as shown in FIGS. 1 and 3) formed through a slit 12.

Figure 2:
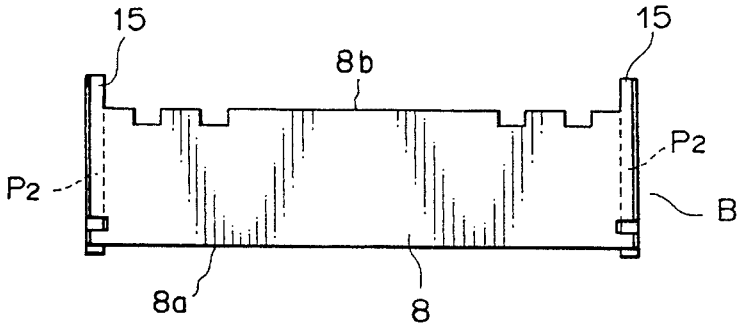
FIG. 2 is a bottom view of a terminal locking tool.

At the front portion of each side plate piece P2 of the terminal locking tool B, a rib 15 which protrudes more forward than each wall piece P1 is provided (see FIGS. 2 and 3). In the recess R2 of the connector housing A corresponding to the side piece P2, a rib guiding groove 16 extends through the connector housing A. The rib guiding groove 16 is formed as a cut-like structure which extends further into the connector housing body than does the portion of the terminal chamber 2 which the side piece P2 obstructs.

Figure 6:
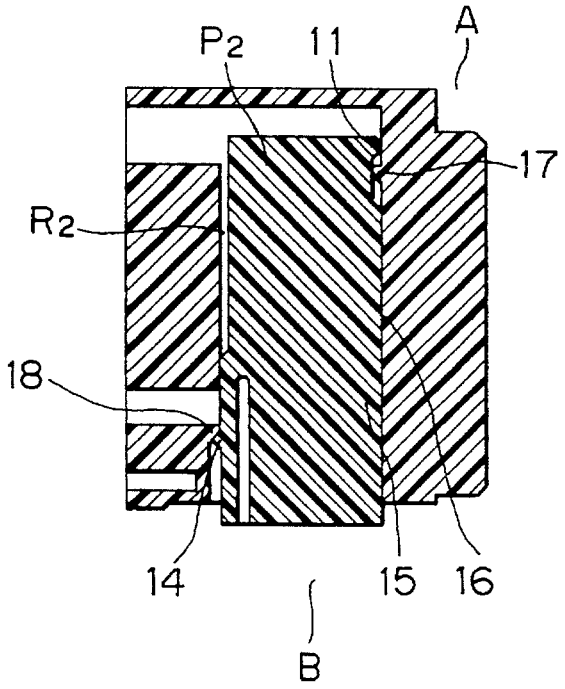
FIG. 6 is a sectional view showing the provisional locking state within a connector housing.

In the above structure, the terminal locking tool B is held at the provisional locking position where the provisional locking protrusion 11 is engaged with the provisional locking projection 17 in a manner that compels its wall pieces P1 and side pieces P2 to be previously inserted into the recesses R1 and R2 (FIG. 6). Accordingly, the rib 15 of the side piece P2, engaged with the rib guiding groove 16 of the connector housing A, is guided while its posture is corrected. Thus, the terminal locking tool B can be easily inserted into the connector housing A to reach the provisional locking position.

In the provisional locking state of the terminal locking tool B, as described in connection with the prior art, the terminal metal fittings C can be inserted into the terminal and primarily locked by a resilient locking piece (not shown) provided in each of the terminal chambers 2.

Figure 7:
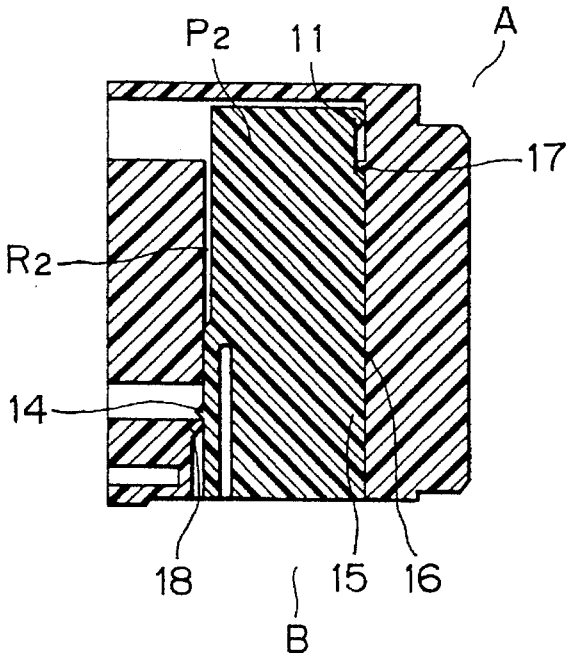
FIG. 7 is a sectional view showing the final locking state within the connector housing.
Figure 8:
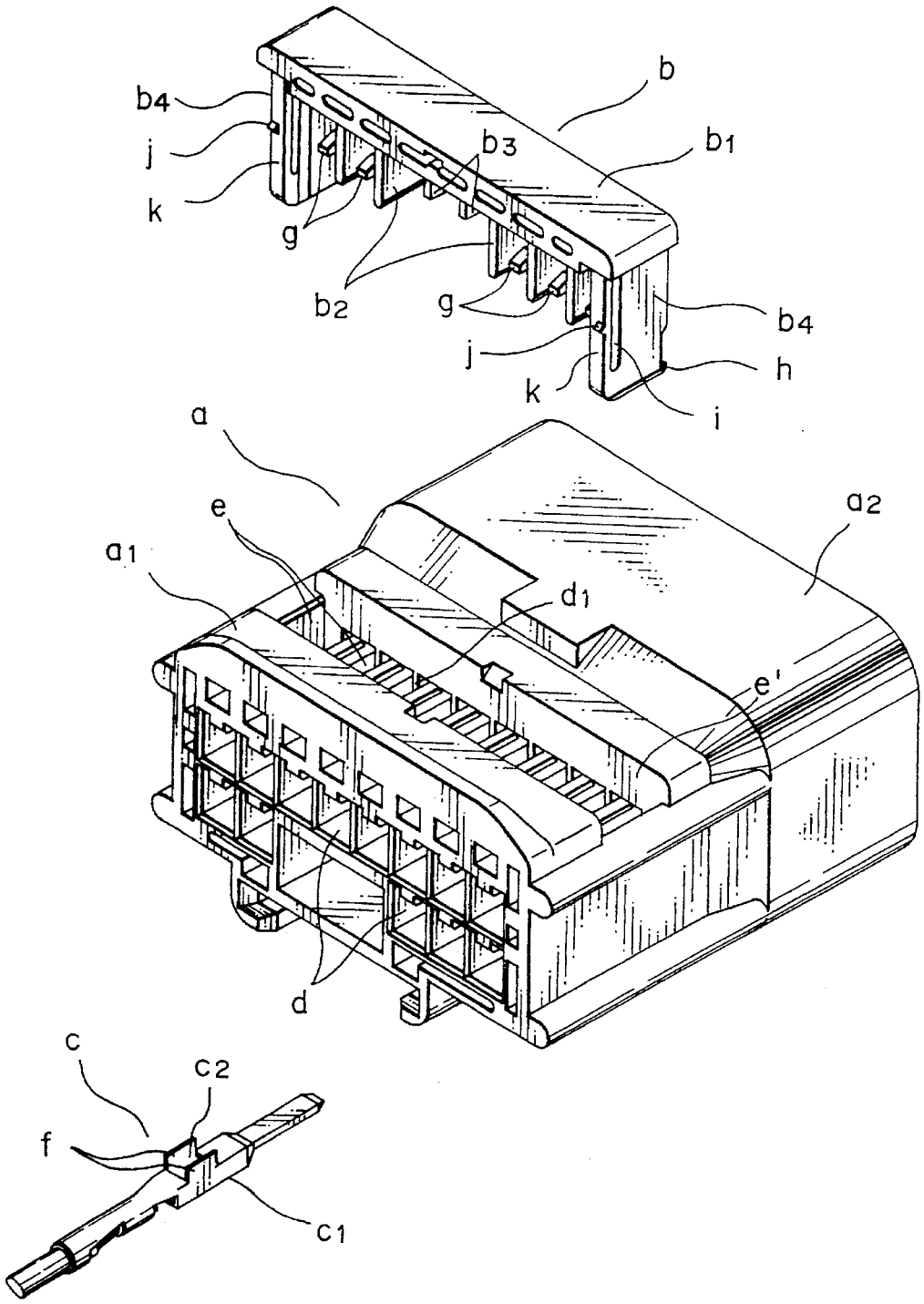
FIG. 8 PRIOR ART
FIG. 8 is an exploded perspective view of the prior art.
Figure 9:
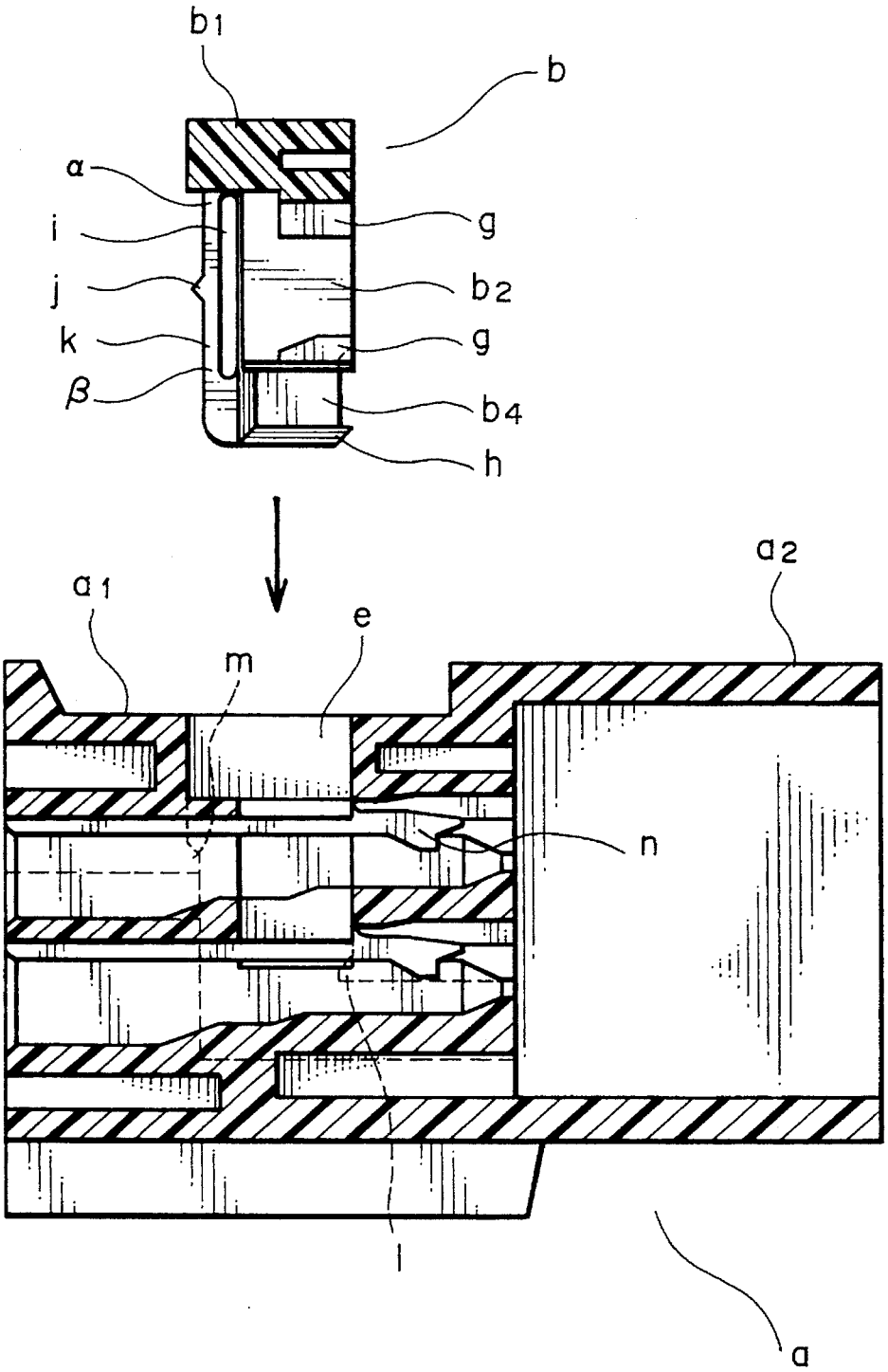
FIG. 9 PRIOR ART
FIG. 9 is a longitudinal sectional view of the terminal locking tool and connector housing before they are coupled to each other.
Figure 10:
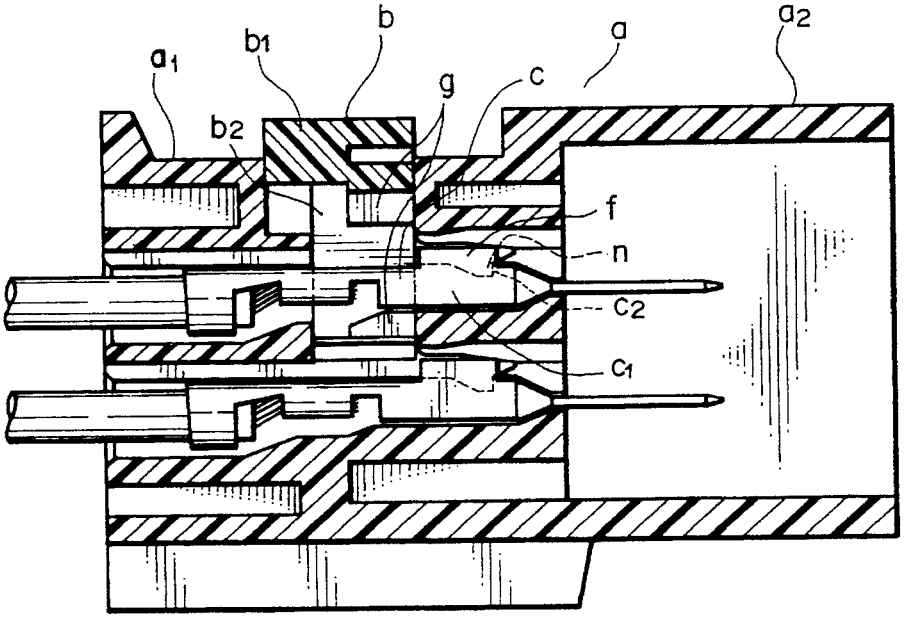
FIG. 10 PRIOR ART
FIG. 10 is a sectional view of the terminal locking tool and connector housing when they are in a provisional locking state.
Figure 11:
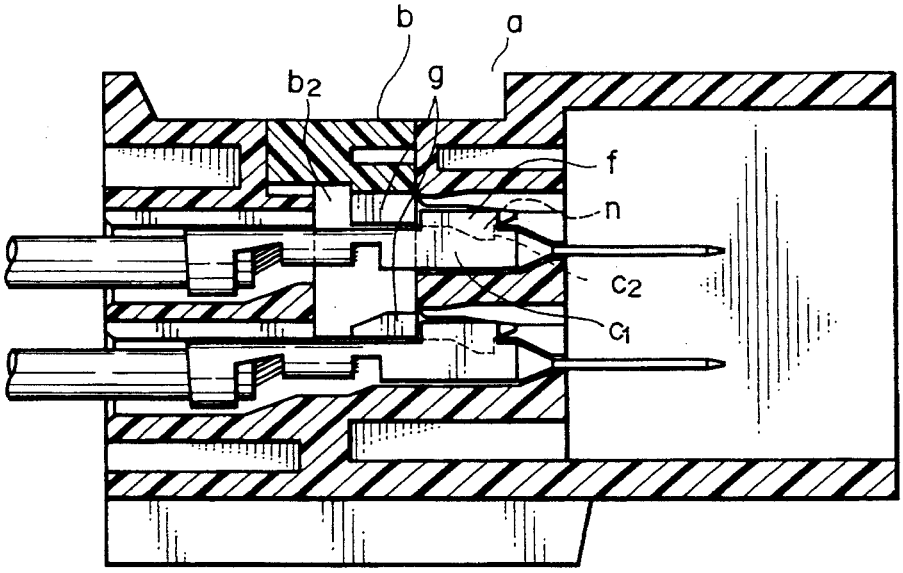
FIG. 11 PRIOR ART
FIG. 11 is a sectional view of the terminal locking tool and connector housing when they are in a final locking state.
Figure 12:
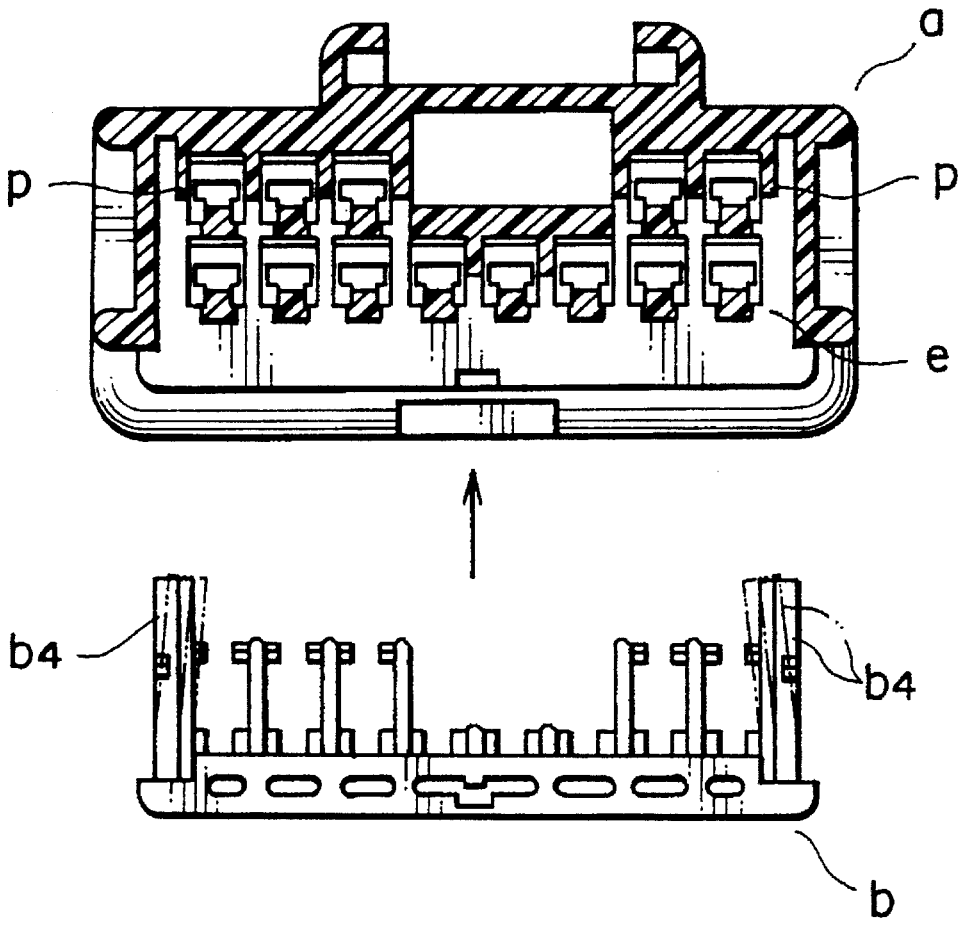
FIG. 12 PRIOR ART
FIG. 12 is a cross sectional view of the terminal locking tool and connector housing when they are coupled to each other.

Upon completion of insertion of the terminal metal fittings C, the terminal locking tool B is further intruded in the connector housing A so that it is shifted from provisional locking position to the final locking position where the final locking protrusion 14 is engaged with the final locking tab 18 (FIG. 7). In the final locking state, the terminal locking portions 10 are located behind the locking piece 9 so that the terminal metal fittings C are locked supplementally.

Embodiments 2 and 3

Figure 4:
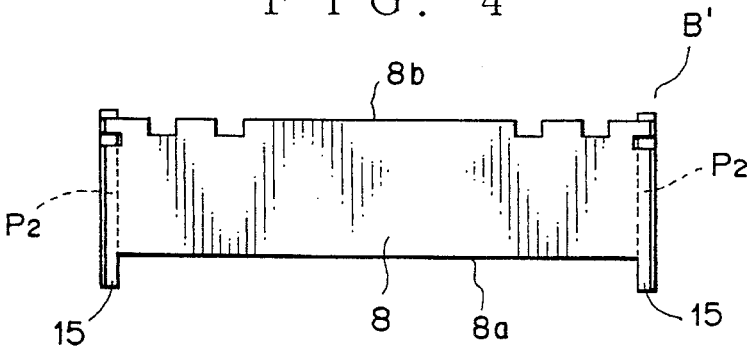
FIG. 4 is a bottom view of another embodiment of the terminal locking tool.
Figure 5:
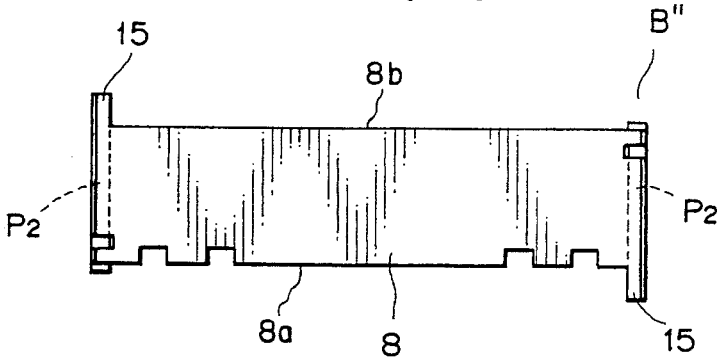
FIG. 5 is a bottom view of still another embodiment of the terminal locking tool.

In an embodiment of FIG. 4, the above ribs 15 are formed at the rear ends of the side pieces P2 of a terminal locking tool B'. In an embodiment of FIG. 5, the ribs 15 are formed at the front end of one of the side pieces P2 of a terminal locking tool B" and the rear end of the other thereof, respectively. In this case, the above guiding grooves 16 are formed at the corresponding positions in the connector housing (not shown).

I claim:

1. A connector equipped with a comb-like terminal locking tool, comprising:

a connector housing defined by a body having substantially rectangularly arranged front, rear, upper and lower and opposed side peripheral walls;

at least one terminal chamber in said housing defined by mutually spaced partitions extending longitudinally from said front wall to said rear wall and including an open end formed in said front wall; an opening portion in said lower peripheral wall and recesses penetrating in comb-like fashion through the housing including recesses adjacent said side walls to traverse said chamber-forming partitions; and a terminal locking tool having a cover plate sized for transverse insertion in said opening portion, and mutually spaced side pieces overlying the exterior of said at least one terminal chamber and at least one wall piece intermediate said side pieces arranged in a comb-shape on said cover plate and adapted for insertion in said recesses;

each of said side pieces having a side edge and a rib extending beyond an elongated edge of said cover plate and extending along a substantial portion of said side edge; and a rib guiding groove in said connector for guiding each of said ribs, each rib-guiding groove having a shape corresponding substantially with an associated one of said ribs and being positioned outside of the terminal chambers which the respective side pieces in said side walls overlie.

2. A connector equipped with a terminal locking tool according to claim 1, wherein said ribs are formed at the front ends of the respective side pieces.

3. A connector equipped with a terminal locking tool according to claim 1, wherein said ribs are formed at the rear ends of the respective side pieces.

4. A connector equipped With a terminal locking tool according to claim 1, wherein said ribs are formed at the front end and rear end of the respective side pieces.

5. A connector equipped with a terminal locking tool according to claim 1, wherein said rib guiding grooves communicate with the recesses which receive said side pieces.

6. A connector equipped with a terminal locking tool, comprising:

a connector housing defined by a body having substantially rectangularly arranged front, rear, upper and lower and opposed side peripheral walls and having a plurality of longitudinally extending terminal chambers in said housing, each of which contain an opening provided on the front peripheral wall, and a plurality of substantially parallelly extending recesses penetrating said housing and including recesses outside said terminal chambers and adjacent the side walls overlying said chambers, a terminal locking tool having a cover plate, a wall piece and side pieces arranged in a comb-shape on said cover plate for transverse insertion into said recesses;

each of said side pieces containing a respective rib extending beyond an elongated edge of said cover plate along a substantial portion of at least one side edge of said side piece; and said connector housing having rib guiding grooves for receiving and guiding said ribs, each rib guiding groove having a shape corresponding substantially to the shape of the rib received therein and being disposed externally of the terminal chambers which the side pieces overlie.

7. A connector equipped with a terminal locking tool according to claim 6, wherein said ribs are formed at the front ends of the respective side pieces.

8. A connector equipped with a terminal locking tool according to claim 6, wherein said ribs are formed at the rear ends of the respective side pieces.

9. A connector equipped with a terminal locking tool according to claim 6, wherein said ribs are formed at the front end and rear end of the respective side pieces.

* * * * *